US007233220B2

(12) United States Patent
Batteux

(10) Patent No.: US 7,233,220 B2
(45) Date of Patent: Jun. 19, 2007

(54) ELECTRICAL SWITCHING DEVICE, RELAY AND ELECTRICAL APPARATUS COMPRISING SAME

(75) Inventor: Pierre Batteux, Vizille (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 10/532,969

(22) PCT Filed: Oct. 22, 2003

(86) PCT No.: PCT/FR03/03136

§ 371 (c)(1),
(2), (4) Date: Apr. 27, 2005

(87) PCT Pub. No.: WO2004/040607

PCT Pub. Date: May 13, 2004

(65) Prior Publication Data

US 2006/0145794 A1 Jul. 6, 2006

(30) Foreign Application Priority Data

Oct. 28, 2002 (FR) ..... 02 13433

(51) Int. Cl.
*H01H 9/00* (2006.01)
*H01F 7/00* (2006.01)
*H01F 7/08* (2006.01)

(52) U.S. Cl. ..... 335/179; 335/181; 335/229; 335/234

(58) Field of Classification Search ..... 335/177–184, 335/229–234
See application file for complete search history.

(56) References Cited

U.S. PATENT DOCUMENTS 5,883,557 A * 3/1999 Pawlak et al. ..... 335/179

FOREIGN PATENT DOCUMENTS

| | | |
|---|---|---|
| DE | 198 02 332 A | 7/1998 |
| FR | 1 348 345 A | 1/1964 |
| FR | 1 448 202 A | 8/1966 |
| FR | 2 184 111 A | 12/1973 |

* cited by examiner

*Primary Examiner*—Ramon M. Barrera
(74) *Attorney, Agent, or Firm*—Steptoe & Johnson LLP

(57) ABSTRACT

The electrical switching device comprises at least a first part comprising at least a first magnetizable element and a first contact zone associated with said first magnetizable element, and at least a second movable part comprising at least a second magnetic element and a second contact zone associated with said second magnetic element. The first or second magnetic element comprises at least one permanent magnetization part to keep the first electrical contact closed and to exert a contact pressure between the first and second contact zones when the movable part is in a first stable position. The electromagnetic relay and/or electrical apparatus comprise electrical contact inputs and control inputs connected to a switching device comprising electromagnetic control coils.

35 Claims, 9 Drawing Sheets

FIG. 20A
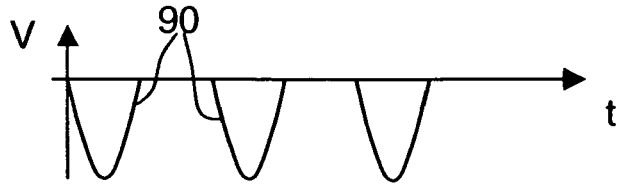
FIG. 20B
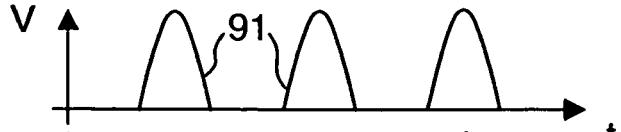
FIG. 20C
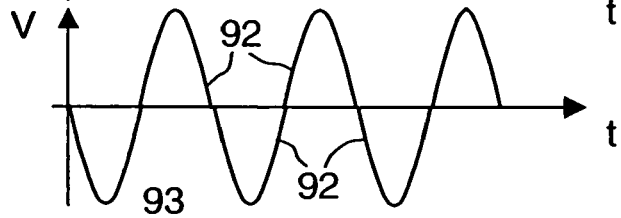
FIG. 21
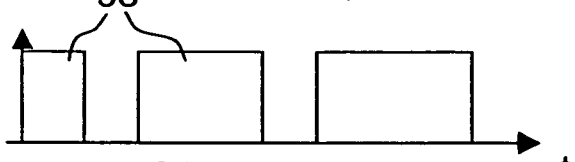
FIG. 22
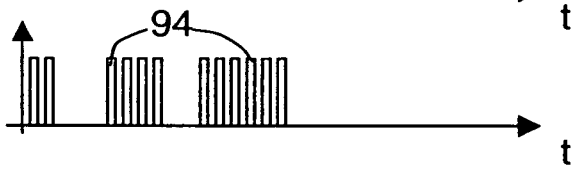
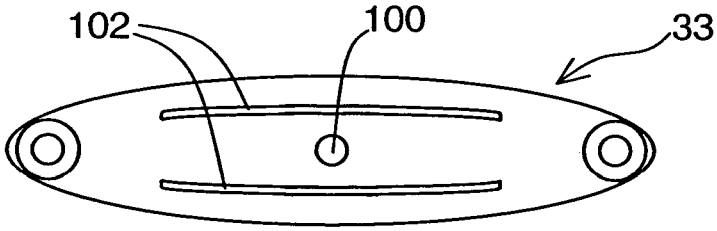
FIG. 23
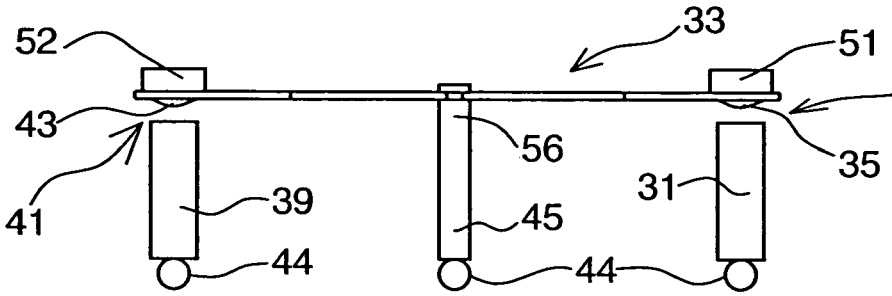
FIG. 24
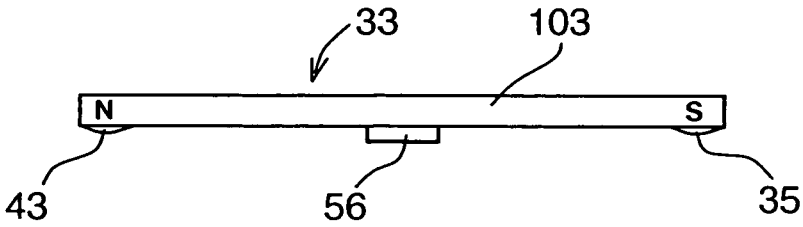
FIG. 25

ELECTRICAL SWITCHING DEVICE, RELAY AND ELECTRICAL APPARATUS COMPRISING SAME

BACKGROUND OF THE INVENTION

The invention relates to an electrical switching device comprising at least one electrical contact able to be kept in a stable position by magnetic means. The invention also relates to an electromagnetic relay with at least two stable states comprising at least a first and a second electrical contact inputs, control inputs, and at least one such switching device. The invention also relates to an electrical apparatus comprising at least a first and a second electrical contact input, and at least one such switching device.

STATE OF THE ART

Known switching devices, integrated in particular in relays and electrical switchgear apparatuses such as switches, comprise electrical contacts controlled in particular by a manual control means or an electromagnetic coil. Generally speaking, the electrical contacts comprise a fixed part and a movable part to open or close an electric circuit. The electrical contacts are kept in an open or closed position in certain apparatuses by a mechanism. In bistable relays, electromagnets are associated with magnets to keep the contacts in stable positions.

FIG. 1 shows a bistable relay comprising a contact block 1 with a fixed part 2 having one or more electrical contact pads 3, and a movable part 4 comprising a flexible blade 5 bearing at least one electrical contact pad 6. The contact block of FIG. 1 is a changeover switch with two electrical contacts connected to connection terminals 7. The contact block 1 is actuated on its movable part by a bistable electromagnetic device 8 comprising a fixed part 9 and a movable part 10 mechanically connected to said contact block. The electromagnetic device 8 comprises a magnetic circuit 11 formed in the fixed part 9 by a magnetic material 12 and a permanent magnet 13, and in the movable part 10 by a blade held by a spring 14. An electromagnetic coil 15 wound onto the magnetic material of the fixed part actuates movement of the movable part 10. If a current flows in a first direction in the coil 15, the movable part is attracted towards the fixed part and the magnetic circuit closes. The permanent magnet 13 then keeps the magnetic circuit closed even if the current in the coil is, interrupted. If a current pulse is injected in a second direction opposite to the first direction, the action of the magnet is cancelled by a reverse magnetic field generated by the coil, and the blade is then urged by the spring 14 back to an open magnetic circuit position. The strength of the magnet 13 is not sufficient to attract the blade held by the spring in the open circuit position. A bistable relay of this type is described in particular in the Patent EP 0,686,989 B1.

FIG. 2 shows a bistable relay comprising a contact block 1 similar to that of FIG. 1 actuated by an electromagnetic device 16 having a movable part 17 with a permanent magnet 18. The fixed part generally comprises a first or a second magnetic circuit 19 and 20 controlled by electromagnetic coils 21 and 22 enabling the magnet to be moved towards the first or the second magnetic circuit. When the magnet is in contact with one of the magnetic circuits, the magnetic induction of said magnet enables the movable part to be kept in a stable state. Thus, the magnetic circuit which retains the movable part with the magnet becomes a closed magnetic circuit and the other magnetic circuit is open.

Certain devices of this type comprise a single electromagnetic control coil and different arrangements of the fixed part. Bistable devices with movement of a movable part bearing the magnet are described in particular in the Patents EP 0,272,164 B1 and FR 2,358,006.

Known switching devices, integrated in particular in bistable relays, enable weak electric currents to be switched or broken in good conditions. When the currents to be switched are strong, for example several Amperes, known devices are generally bulky. In addition, the contact blocks have a large temperature rise and the magnetic circuits have to exert strong forces to move the movable parts. Such switching devices are difficult to integrate in electrical apparatuses of small dimensions able to be actuated manually.

SUMMARY OF THE INVENTION

It is one object of the invention to provide an electrical switching device enabling a good electric current conduction, a good electric circuit switching or interruption and/or having reduced dimensions or volume. It is also an object of the invention to provide a relay and an electrical apparatus comprising such a device.

A switching device according to the invention comprises:

at least a first part comprising at least a first magnetizable element and a first contact zone associated with said first magnetizable element, at least a second movable part comprising at least a second magnetic element and a second contact zone associated with said second magnetic element, said second movable part having at least a first stable position to keep a first electrical contact closed between the first and second contact zones and a second stable position to keep said first electrical contact open, and electromagnetic actuating means acting on the second movable part to make the latter change position and comprising at least a first electromagnetic coil wound onto at least a first magnetizable element of the first part to act in attraction or repulsion on at least a second magnetic element of the second movable part and to perform a change of stable state of said second movable part, the first or second magnetic element comprising at least one permanent magnetization part to keep the first electrical contact closed and exert a contact pressure between the first and second contact zones by a magnetic attraction exerted between the first and second magnetic elements when the movable part is in its first stable position.

Advantageously, the electromagnetic actuating means comprise at least a second electromagnetic coil wound onto at least a third magnetizable element of the first part to act in attraction or in repulsion on at least a second magnetic element of the second movable part and to perform a change of stable state of said second movable part.

Advantageously, the first and second electromagnetic coils are designed to be controlled by electrical pulses to generate reverse magnetic fields performing a repulsion and an attraction and to make the stable position of the second movable part change between a first and a second stable position closing at least one electrical contact between a contact zone of the first part and a contact zone of the second movable part.

Advantageously, the first and second electromagnetic coils are designed to be controlled by electrical pulses to generate magnetic fields of the same direction performing two repulsions and to position the second movable part in a third stable position where the contact zones of the second movable part are not in electrical contact with the contact zones of the first part.

Advantageously, the first part comprises a third magnetizable element to keep the second movable part in the second stable position.

In a preferred embodiment, the second movable part comprises at least one permanent magnet arranged in proximity to a contact zone.

Advantageously, the second movable part is composed of a material comprising a mainly permanent magnetization part.

Preferably, the permanent magnetization part or the permanent magnet have a magnetic induction greater than 1 tesla.

Advantageously, the second movable part has an elongate shape able to pivot and comprises at least one contact zone and one magnetic attraction zone towards at least one end. Preferably, the second movable part comprises at least one contact zone and one permanent magnet at a first end and at a second end.

In a particular embodiment, the second movable part has a flexible constitution able to be fixed by a point situated in a central zone, and comprises at least one contact zone and one magnet towards at least one end. Preferably, the second movable part comprises at least one opening to a central zone.

In a preferred embodiment:

the first part comprises the first magnetizable element associated with a first contact zone and a third magnetizable element associated with a third contact zone, and the second movable part comprises a second contact zone towards a first end designed to be in contact with the first contact zone of the first part, and a fourth contact zone towards a second end designed to be in contact with the third contact zone of the first part, in a first stable position of the movable part, the first and second contact zones are maintained to form a closed contact and the third and fourth contact zones form an open contact, and in a second stable position of the movable part, the third and fourth contact zones are maintained to form a closed contact and the first and second contact zones form an open contact.

Preferably, the first, second, third and fourth contact zones are electrically connected to electrical connection means.

Advantageously, the second movable part comprises a first permanent magnet towards the first end to operate in conjunction with the first magnetizable element of the first part and a second permanent magnet towards the second end to operate in conjunction with the third magnetizable element of the first part.

In a preferred embodiment, the switching device comprises maintaining means to keep the second movable part in a third stable position wherein the contact formed by the first and second contact zones and the contact formed by the third and fourth contact zones are open.

Preferably, the maintaining means comprise a support element in the form of a flat part arranged on the first part to receive a first side of the second movable part and pressure means to keep a central zone of the second movable part against said support element. For example, the pressure means are formed by a spring.

Preferably, the pressure means are formed by a third permanent magnet and a fourth magnetizable element arranged on the support element and on the central zone of the movable part.

In a preferred embodiment, the switching device comprises manual or mechanical actuating means acting on the second movable part to make it change stable state.

In a particular embodiment, the second movable part has a flexible constitution able to be fixed by a point situated in a central zone, and comprises at least one contact zone and a magnet with two ends to form two contacts with contact zones of magnetizable elements of the first part, said two contacts being able to be closed simultaneously.

Advantageously, at least one magnetic or magnetizable element enables an electric current designed to flow in at least one electrical contact to be conducted through the material that constitutes it.

An electromagnetic relay according to the invention with at least two stable states comprising at least a first and a second electrical contact inputs, control inputs, and at least one switching device as defined above, the first electrical contact input being connected to the second movable part, the second electrical contact input being connected to a first contact zone of the first part, and the control inputs being connected to at least a first electromagnetic coil arranged on at least a first magnetizable element of the first part.

In a preferred embodiment, the relay comprises at least a second electromagnetic coil connected to the control inputs and arranged on at least a third magnetizable element of the first part.

In another embodiment, the relay has at least three stable states and comprises a third contact zone connected to a third contact input and means for keeping the second movable part in a third stable position where the electrical contacts between the first, second and third contact zones are open, the first and second electromagnetic coils being designed to be commanded in attraction and repulsion to establish an electrical contact and in double repulsion to open the contacts.

An electrical apparatus according to the invention, comprising at least a first and a second electrical contact inputs, comprises:

at least one switching device as defined above with at least two stable positions, the first electrical contact input being connected to the second movable part, the second electrical contact input being connected to a first contact zone of the first part, and a control circuit connected to at least a first electromagnetic coil arranged on a first magnetizable element of the first part.

In a preferred embodiment, the switching device comprises at least a second electromagnetic coil connected to the control circuit and arranged on at least a third magnetizable element of the first part.

Advantageously, the switching device has three stable states and comprises a third contact zone connected to a third contact input and means for keeping the second movable part in a third stable position where the electrical contacts between the first, second and third contact zones are open, the first and second electromagnetic coils being designed to be commanded in attraction and repulsion to establish at least one electrical contact and in double repulsion to open the contacts.

In a preferred embodiment, the electrical apparatus comprises manual or mechanical actuating means acting on the second movable part to make it change stable state.

Advantageously, the control circuit comprises at least one control input able to receive control signals.

Advantageously, the control signals applied to the input can be polarization signals, pulse duration signals and/or number of pulse signals.

Advantageously, the control circuit comprises at least one remote control input by communication bus to receive control signals.

Advantageously, the control circuit comprises remote control receipt means to receive control signals.

Advantageously, the control circuit comprises processing means to process control signals and to control the electromagnetic coils according to said signals. Preferably, the processing means perform remote control switch, time switch and/or controlled switch functions.

BRIEF DESCRIPTION OF THE DRAWINGS

Other advantages and features will become more clearly apparent from the following description of particular embodiments of the invention, given as non-restrictive examples only, and represented in the accompanying drawings in which:

FIGS. 20A, 20B, 20C, 21 and 22 represent control signals able to be used by control circuits of switching devices according to embodiments of the invention;

FIG. 23 represents a particular embodiment of a movable part of a device according to an embodiment of the invention;

FIG. 24 represents a switching device according to an embodiment of the invention comprising a movable part according to FIG. 23;

FIG. 25 represents a second particular embodiment of a movable part of a device according to an embodiment of the invention.

DETAILED DESCRIPTION OF PREFERRED EMBODIMENTS

Figure 1:
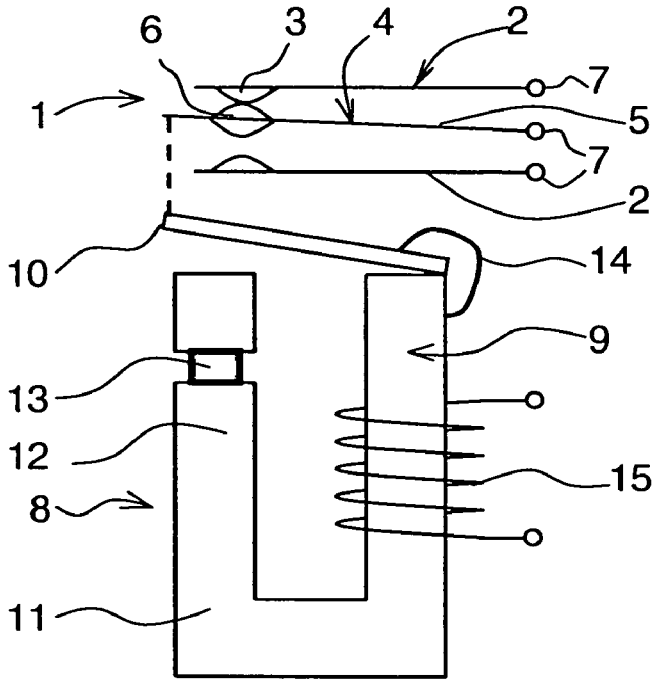
FIG. 1 (Prior Art)
FIGS. 1 and 2 represent known switching devices of bistable relays of the prior art.
Figure 2:
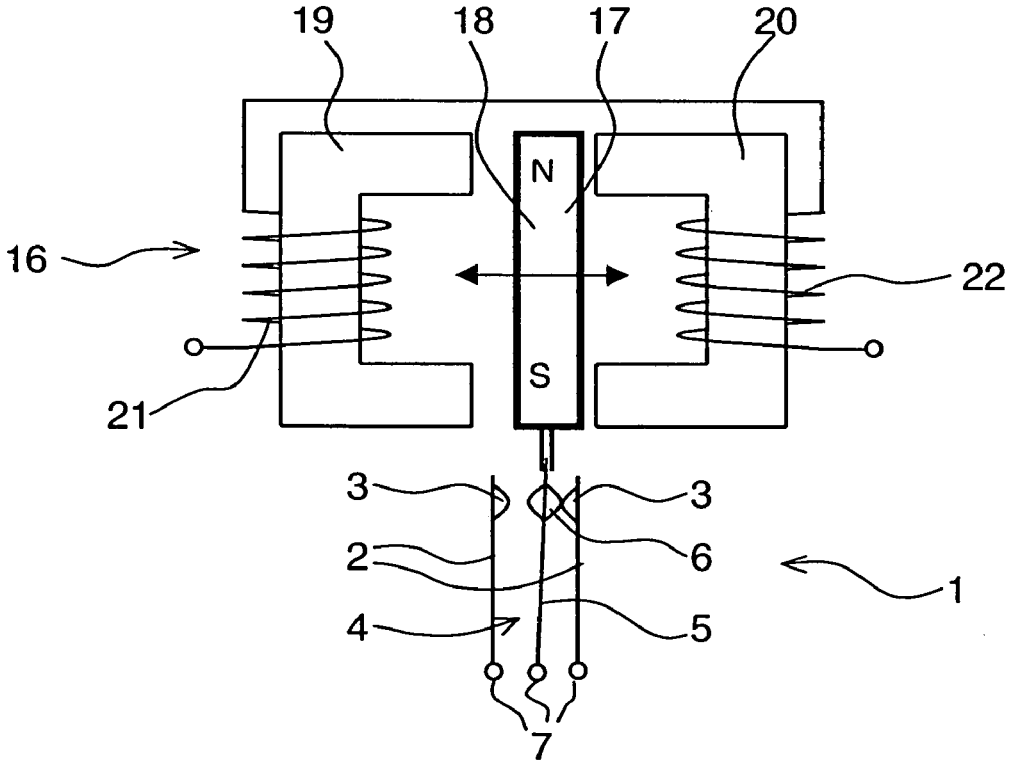
FIG. 2 (Prior Art)
Figure 3:
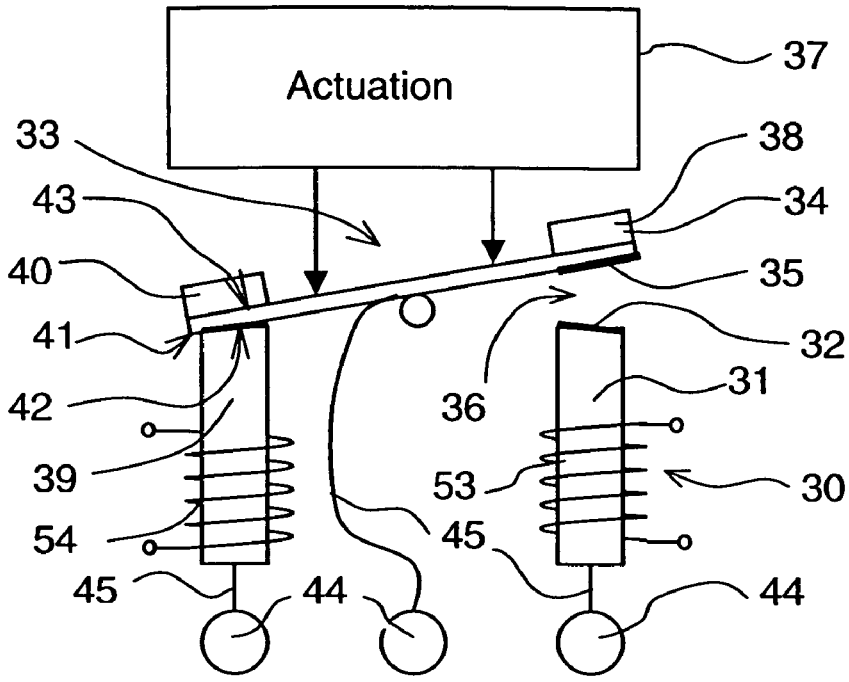
FIG. 3 represents a switching device according to a first embodiment of the invention with two stable positions.

In a device according to an embodiment of the invention represented in FIG. 3, a first, preferably fixed, part 30 comprises a first magnetizable element 31 and a first contact zone 32 associated with said first magnetizable element 31, and a second movable part 33 comprises a second magnetic element 34 and a second contact zone 35 associated with said second magnetic element 34. Said second movable part 33 has at least a first stable position to keep a first electrical contact 36 closed between the first and second contact zones 32 and 35 and a second stable position to keep said first electrical contact open. Actuating means 37 able to be electromagnetic, and possibly manual or mechanical, enable action to be performed on the second movable part to make it change position. The first or second magnetic element comprises at least one permanent magnetization part to keep the first contact closed and to exert a contact pressure between the first and second contact zones.

The contact pressure is exerted by a magnetic attraction between the first and second magnetic elements when the movable part is in its first stable position where the first contact 36 is closed. For example, the second magnetic element can be a magnet 38 arranged on the movable part 33, the first magnetizable element 31 being able to be made of magnetic material, for example soft iron. In a preferred embodiment, the actuating means comprise a first electromagnetic coil 53 to act on the magnet 38 of the second magnetic element of the movable part.

In the embodiment of FIG. 3, the first part 30 comprises a third magnetizable element 39 to keep the second movable part 33 in the second stable position. A second magnet 40 arranged on the movable part ensures that the latter is kept in the second stable position by a magnetic attraction exerted with the third magnetizable element 39. The switching device can comprise a second electrical contact 41 comprising a third contact zone 42 associated with the third magnetizable element 39 and a fourth contact zone 43 on the movable part 33. In this case, the actuating means comprise a second electromagnetic coil 54 to act on the magnet 40 of the second magnetic element of the movable part.

Advantageously, the permanent magnets are arranged in proximity to the contact zones to ensure a good contact pressure. Preferably the permanent magnetization part or the permanent magnet have a magnetic induction greater than 1 tesla with a volume smaller than 1 cubic millimeter ($mm^3$) for a rated current in the contacts of about 1 ampere. In this case, a device able to operate at 10 amperes can have a magnet smaller than 10 $mm^3$. With magnets with an induction of more than 3 teslas per $mm^3$, a switching device will have a magnet of about 3 $mm^3$ for 10 amperes.

Preferably, the movable part 33 has an elongate shape able to pivot and comprises a contact zone and a permanent magnet at each end.

For example, to constitute a changeover switch with two contacts, in a switching device according to an embodiment of the invention, the first part 30 comprises the first magnetizable element 31 associated with a first contact zone 32, and a third magnetizable element 39 associated with a third contact zone 42, and the second movable part 33 comprises a second contact zone 35, towards a first end, designed to be in contact with the first contact zone 32 of the first part, and a fourth contact zone 43, towards a second end, designed to be in contact with the third contact zone 42 of the first part. In a first stable position of the movable part, the first and second contact zones 32 and 35 are maintained to form a closed contact and the third and fourth contact zones 42 and 43 form an open contact, and in a second stable position of the movable part, the third and fourth contact zones 42 and 43 are maintained to form a closed contact and the first and second contact zones 32 and 35 form an open contact. The first, second, third and fourth contact zones are electrically connected to electrical connection terminals by means of electrical conductors and/or the material of the magnetizable elements. The use of the magnetic or magnetizable elements associated with an electrical conduction function enables the volume of the switching device to be reduced. For example, the magnetic or magnetizable elements can be associated with electrical conductors in a single element or be used as conductors themselves. Thus, a magnetic element can have two types of function, advantageously, magnetic type functions for keeping in a stable position and for exerting a contact pressure, and electrical type functions for electrical contact with the movable part and for electrical conduction between connection terminals and said contact.

Figure 4:
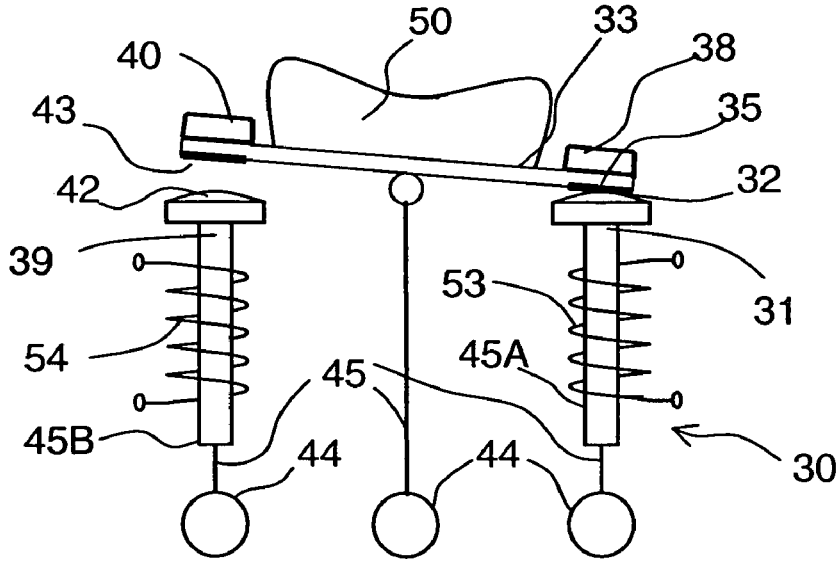
FIG. 4 represents a switching device according to an alternative of the embodiment of FIG. 3.

In the embodiment of FIG. 4, the first part comprises a first electrical conductor 45A associated with a first magnetizable element 31. To improve rocking of the changeover switch and to ensure a second stable position, the first part comprises a third magnetizable element 39 and a second conductor 45B. The embodiment of FIG. 4 shows a manual actuating device 50 to actuate the movable part 33 and to make it change stable position independently from the electromagnetic interactions performed by the coils 53 and 54 acting on the magnets 40 and 38.

Figure 5:
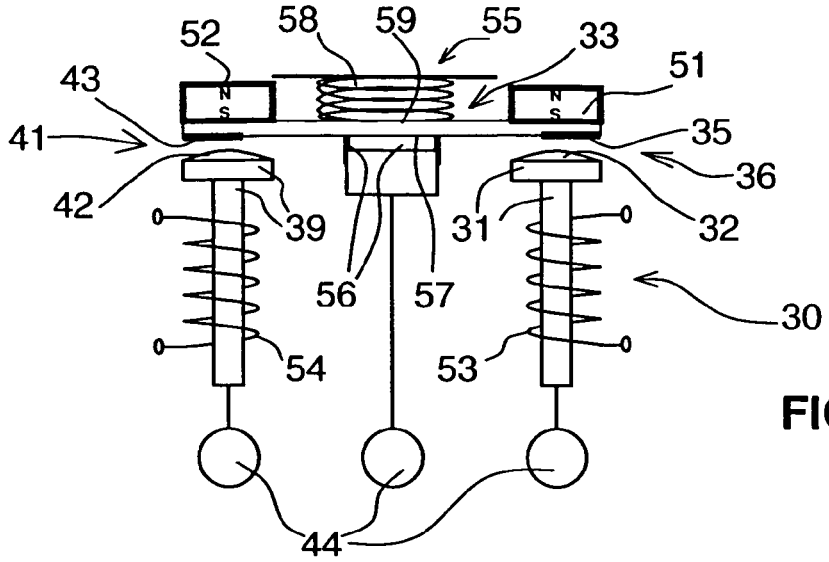
FIG. 5 represents a switching device according to a second embodiment of the invention with three stable positions.

In the embodiment of FIG. 5, the second movable part 33 comprises a first permanent magnet 51 towards the first end to operate in conjunction with the first magnetizable element 31 of the first part and a second permanent magnet 52 towards the second end to operate in conjunction with the third magnetizable element 39 of the first part. The device of FIG. 5 comprises electromagnetic actuating means comprising a first electromagnetic coil 53 wound onto the first magnetizable element 31 of the first part to act in attraction or in repulsion on the second magnetic element of the second movable part 33 and to perform a change of stable state of said movable part. In this embodiment, the electromagnetic actuating means comprise a second electromagnetic coil 54 wound onto the third magnetizable element 39 of the first part to act in attraction or in repulsion on at least a second magnetic element of the second movable part and to make said second movable part change stable state. Thus, the coil 53 and magnetizable element 31 operate in conjunction with the magnet 51 and coil 54 and the magnetizable element 39 operates in conjunction with the magnet 52 to make the movable part 33 change state. In a first position the contact zones 32 and 35 form a closed contact whereas in a second position the contact zones 32 and 35 form an open contact and the contact zones 42 and 43 form a closed contact.

For example, the first and second electromagnetic coils 53 and 54 are controlled by electrical impulses to generate reverse magnetic fields performing a repulsion and an attraction and to make the stable position of the second movable part change between a first and a second stable position.

In the embodiment of FIG. 5, the switching device also comprises maintaining means 55 to keep the movable part 33 in a third stable position wherein the contact 36 formed by the first and second contact zones 32 and 35 and the contact 41 formed by the third and fourth contact zones 42 and 43 are open.

Advantageously, the maintaining means comprise a support element 56 in the form of a flat part or a stop arranged on the first part to receive a first side 57 of the second movable part 33 and pressure means 58 to keep a central zone 59 of the second movable part pressed against the support element. For example, in FIG. 5 the pressure means are formed by a spring.

Figure 6:
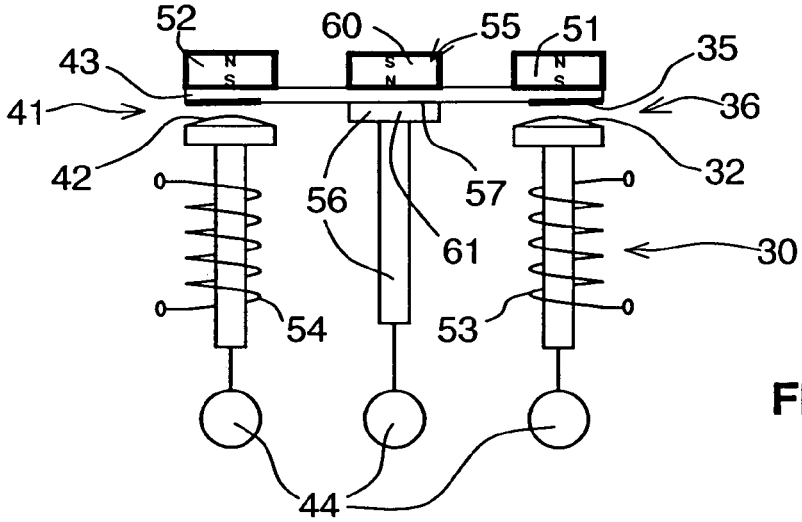
FIG. 6 represents a switching device according to a third embodiment of the invention with three stable positions.

In FIG. 6, the pressure means are formed by a third permanent magnet 60 arranged on the central part of the movable part and a fourth magnetizable element 61 arranged on the support element. To actuate the second movable part and move it to its third stable position where the two contacts are open, the first and second electromagnetic coils are controlled by electrical impulses generating magnetic fields of the same direction performing two repulsions.

Figure 7:
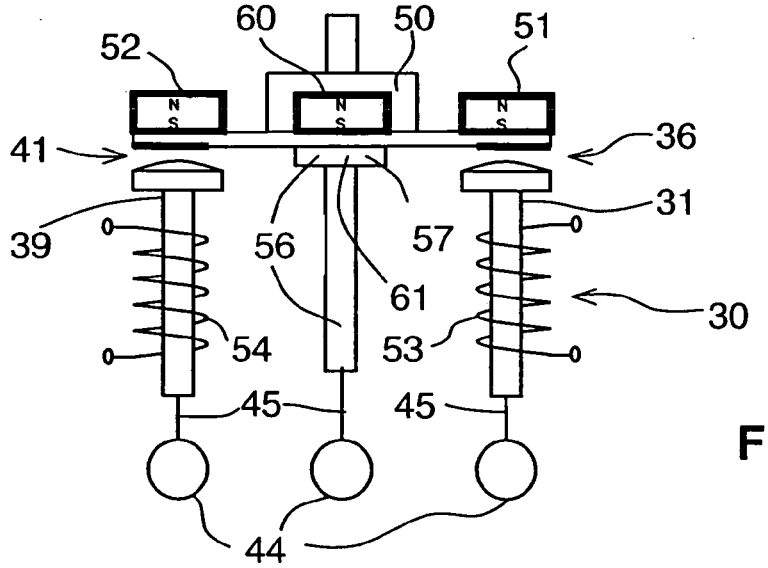
FIG. 7 represents a switching device according to a fourth embodiment of the invention with three stable positions.

In the embodiment of FIG. 7, manual or mechanical actuating means 50 act on the second movable part to make it change stable state. When it is in its third position, the magnet 60 operates in conjunction with the fourth magnetizable element 61 preferably comprising a flat part to hold the movable part. In this stable position, the contact zones 35 and 43 of the second movable part are not in electrical contact with the contact zones 32 and 42 of the first part.

Figure 8:
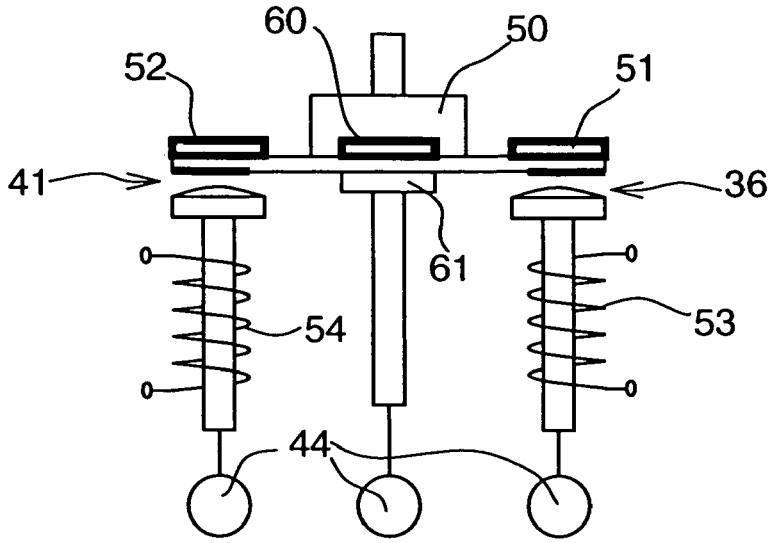
FIGS. 8, 9 and 10 represent three positions of a switching device according to an embodiment of the invention with three stable positions.
Figure 9:
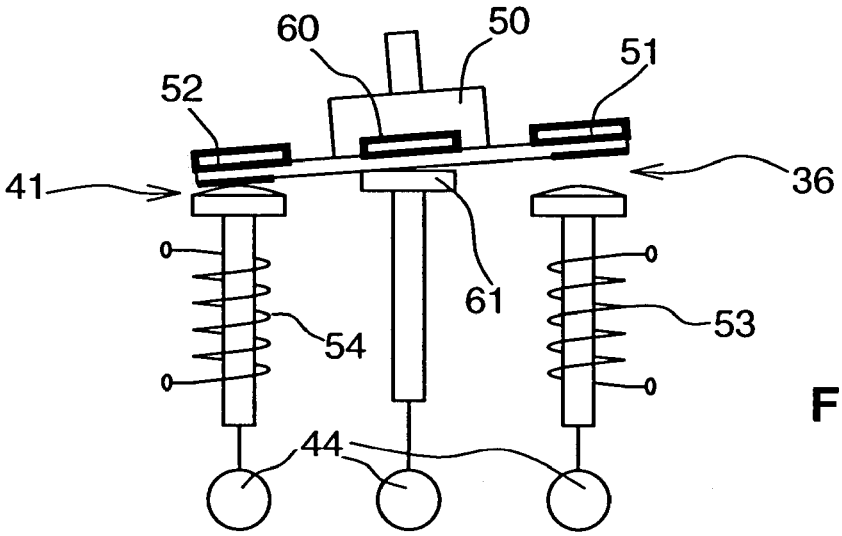
Figure 10:
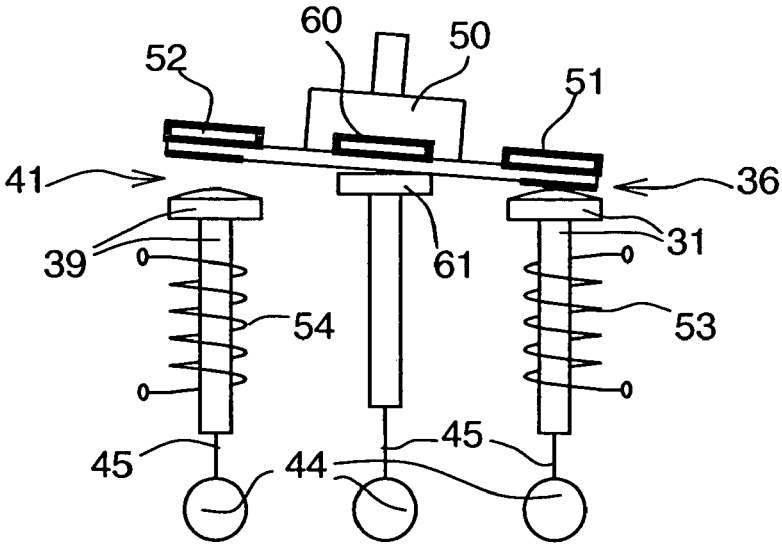

FIGS. 8, 9 and 10 show a switching device comprising actuation by electromagnetic coils and a manual actuating element 50. Thus two actuating means enable the position of the movable part 33 to be changed. In FIG. 8, the movable part is in its third stable position where the contacts 36 and 41 are open.

In FIG. 9, the first contact 36 is open and the second contact 41 is closed by an action on the manual actuating element 50 or by electrical impulses on the electromagnetic coils. In this case, the coil 53 has been commanded to act in repulsion on the magnet 51, and the coil 54 is commanded to act in attraction on the magnet 52.

In FIG. 10, the first contact 36 is closed and the second contact 41 is opened by an action on the manual actuating element 50 or by electrical impulses on the electromagnetic coils. In this case, the coil 54 has been commanded to act in repulsion on the magnet 52, and the coil 53 is commanded to act in attraction on the magnet 51.

Figure 11:
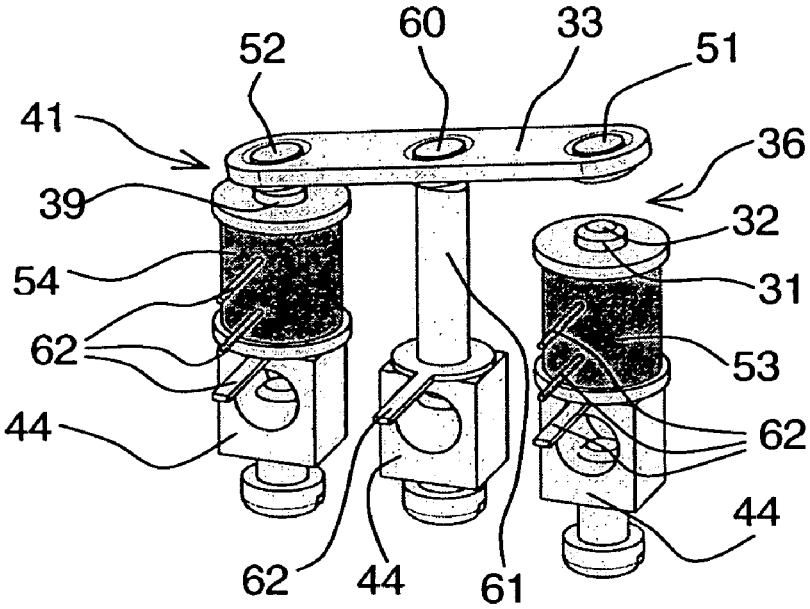
FIG. 11 represents a switching device according to the invention designed to form part of an electrical apparatus.

FIG. 11 represents a switching device according to the invention designed in particular to form part of an electrical apparatus of small dimensions. The first magnetizable element 31 is directly connected to a connection terminal 44 and it receives over its length the electromagnetic control coil 53, the first contact zone 32 at the end of the magnetizable element 31 is salient from the coil 53. The magnetizable element 31 also acts as conductor between the contact zone and the connection terminal. In this arrangement the magnetizable element 31 has magnetic control functions of the movable part being the core of the coil 53 and maintaining functions of the movable part by cooperating with the magnet 51, and also performs a fixed contact part function having a contact zone 32 and an electrical conductor function by connecting the zone 32 to the terminal 44. Such an embodiment enables the size of the switching device to be considerably reduced. The third magnetizable element 39 and the coil 54 are achieved and arranged in the same manner as the element 31 and coil 53. The fourth magnetizable element 61 can be achieved in the same manner as the first and third magnetizable elements 39. It comprises a contact zone that is in contact with the movable part 33 and operates in conjunction with the magnet 60 in the central part of the movable part to ensure a contact pressure and pivoting of the movable part as well as maintaining the latter in position. The movable part 33 can be made from conducting material such as copper with suitable surface treatments towards the electrical contact zone. Permanent magnets 51, 52, and 60 arranged towards the ends and the central zone of the movable part 33 are preferably stuck or crimped onto the conducting material.

Connections of the coils 53 and 54 and of the contact conductors 45 can also be performed by output pins or tabs 62 able to be soldered onto a printed circuit or receive electric wires that are either soldered or connected by spade connectors.

Figure 12:
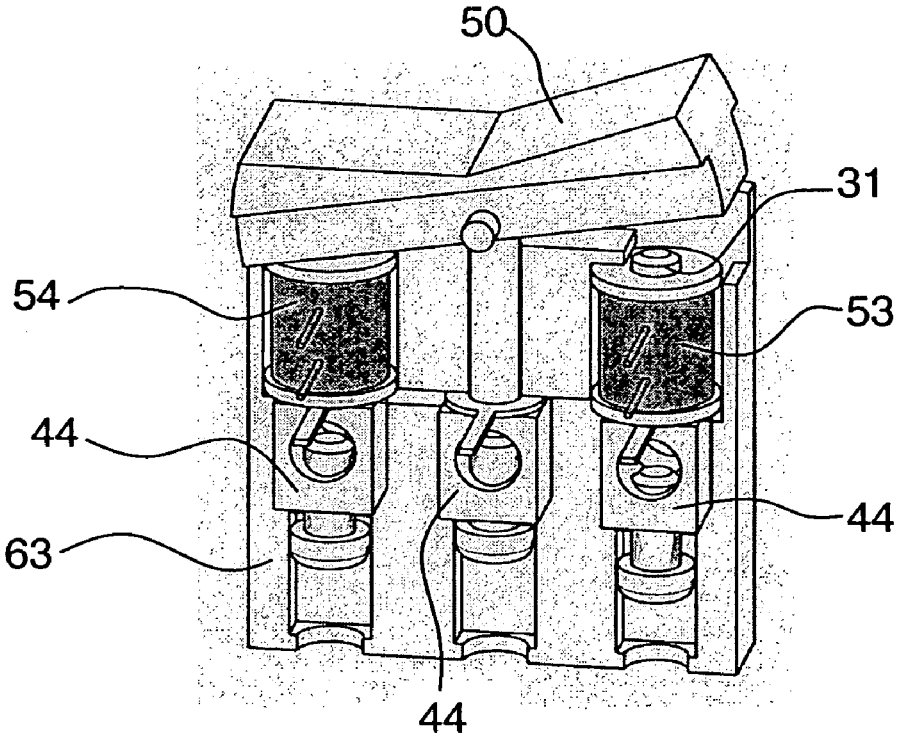
FIG. 12 represents an electrical apparatus comprising a switching device according to an embodiment of the invention able to be controlled by a manual control or electromagnetic control coils.

In FIG. 12, a switching device according to FIG. 11 is integrated in an electrical breaking or switching apparatus. This electrical apparatus comprises a base 63 made of insulating material to receive and secure the different elements of the switching device. In this figure, it also comprises a manual actuating means 50 to act manually on the movable part. The manual actuating means 50 can also be a mechanical actuating means actuated in particular by movement of an object, for example a machine or a mechanism.

Figure 13:
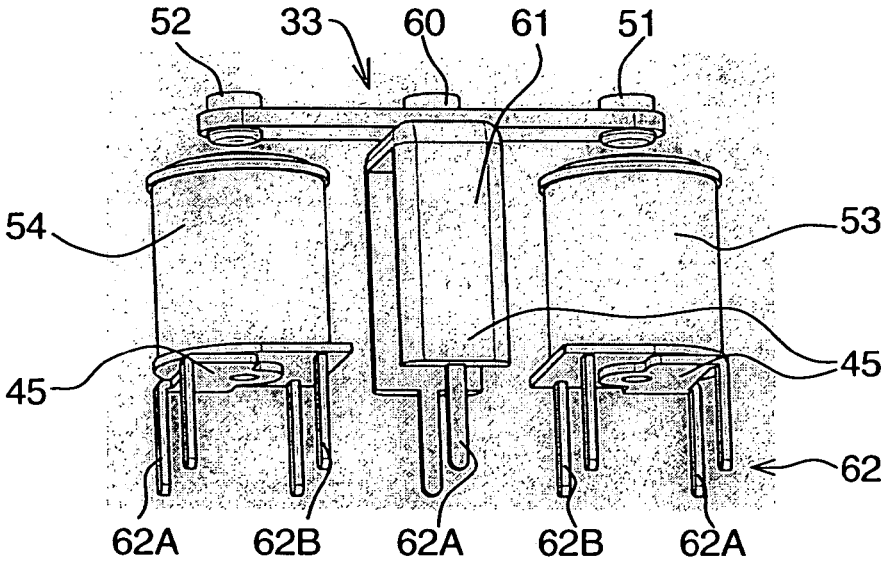
FIG. 13 represents a switching device according to an embodiment of the invention with two or three stable positions designed to be mounted in particular on a printed circuit or to form part of an electrical apparatus such as a relay.

FIG. 13 represents a switching device with two or three stable positions designed to be mounted in particular on a printed circuit or to form part of an electrical apparatus such as a relay. The contact conductors 45 and the coil connections are terminated by connecting pins or tabs 62. The conductors 45 are crimped directly onto the magnetizable elements of the first part. The fourth magnetizable element 61 also has the function of support element 56 to support the central part of the fixed part, in particular in its third stable position where the contacts are open, and a function of electrical conductor 45.

In the case of a fitting as a relay, inputs 62A correspond to electrical contact inputs and inputs 62B correspond to control inputs. A first electrical contact input 62A is connected to the second movable part by means of the fourth magnetizable element 61, a second electrical contact input 62A is connected to a first contact zone 32 of the first part by means of the first magnetizable element 31, a third electrical contact input 62A is connected to a third contact zone 42 of the first part by means of the third magnetizable element 39, and the control inputs 62B are connected to the first and second electromagnetic coils 53 and 54 arranged on the first and third magnetizable elements 31 and 39 of the first part.

Figure 14:
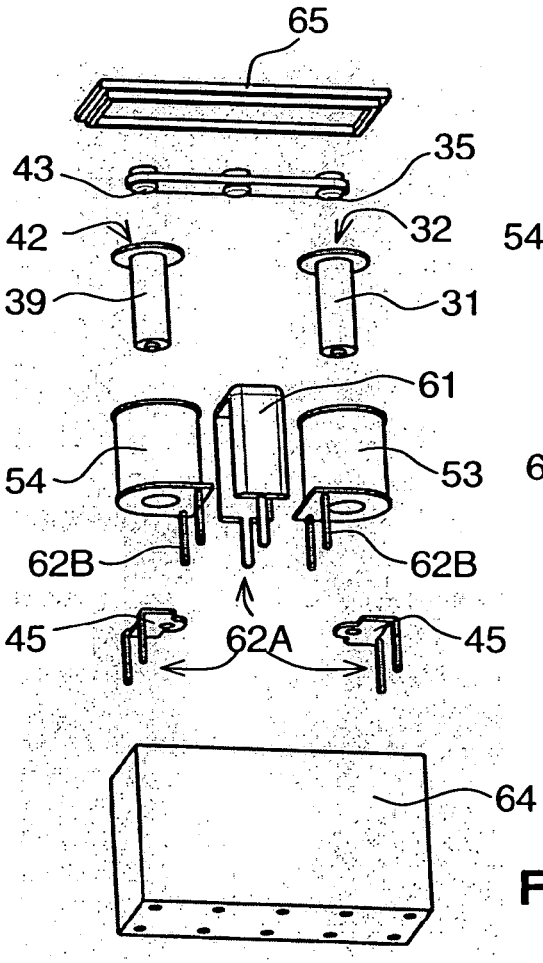
FIGS. 14 and 15 represent views of a relay according to an embodiment of the invention comprising a switching device according to FIG. 13.
Figure 15:
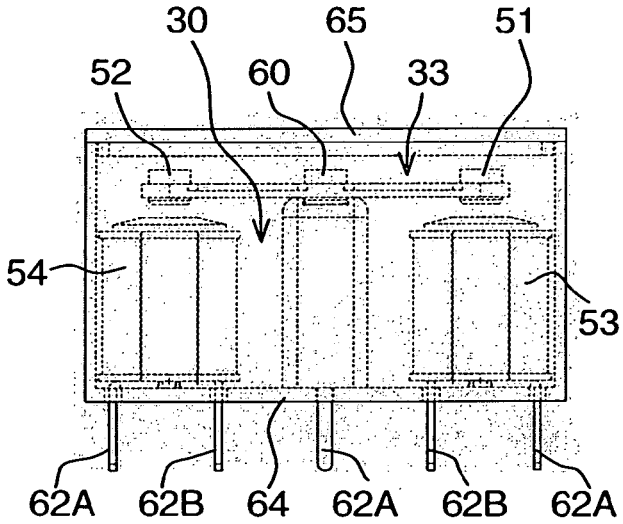

FIGS. 14 and 15 represent views of a relay according to an embodiment of the invention comprising a switching device according to FIG. 13. The relay comprises a support 64, for example in the form of a case, and a cover 65 closing said support. Passages arranged in the case enable electrical connection inputs 62 to pass. FIG. 14 shows an exploded view of the elements of the switching device. The assembled relay is represented in the view of FIG. 15 where the elements are in place. This view shows advantages of the invention, in particular the reduction of space and volume permitted by such an arrangement. Grouping of electrical and magnetic functions in a single element enables these advantages to be achieved.

The relay of FIGS. 13, 14 and 15 can be a relay with two stable positions or three positions depending on the control mode of the coils 53 and 54. The first and second coils are commanded in attraction and repulsion to establish an electrical contact and in double repulsion to open the two contacts.

Figure 16:
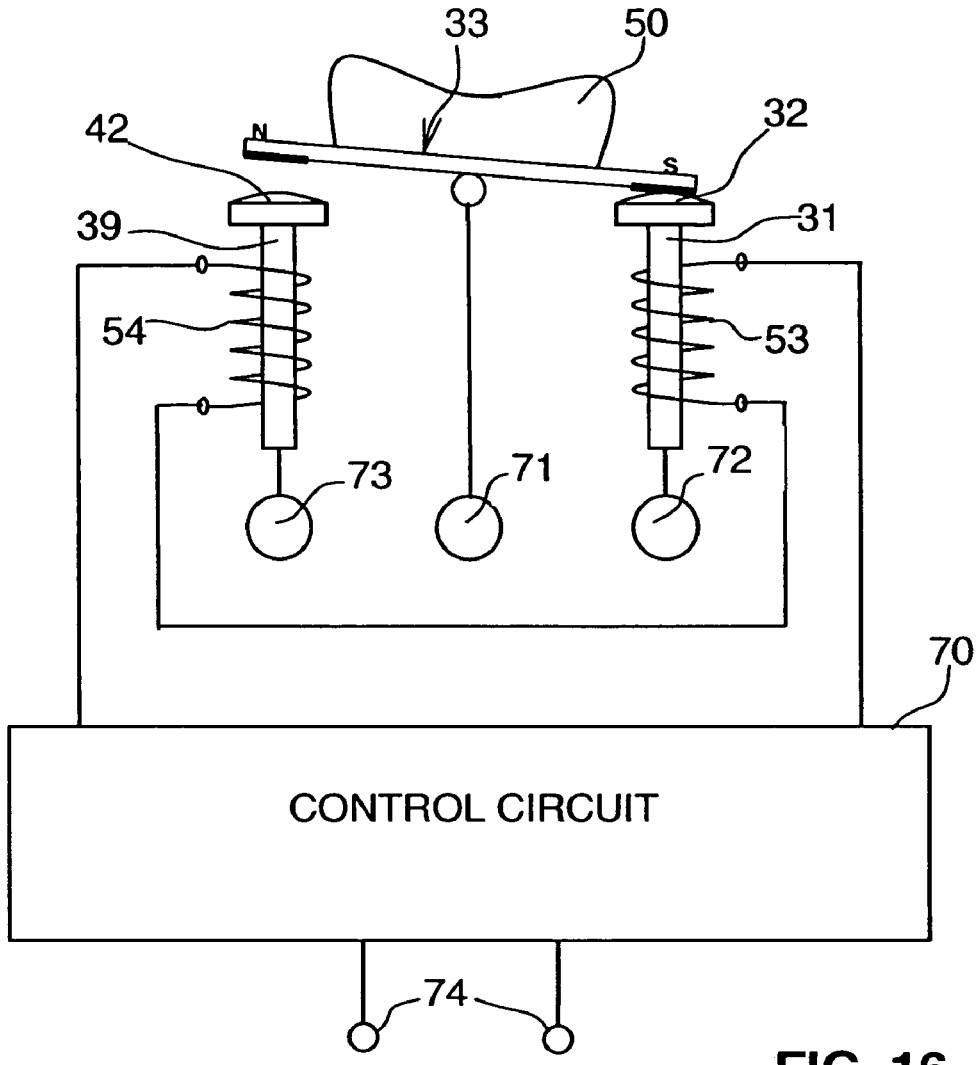
FIG. 16 represents a diagram of an electrical apparatus comprising a switching device according to an embodiment of the invention and a control circuit.

FIG. 16 represents a diagram of an electrical apparatus comprising a switching device according to an embodiment of the invention and a control circuit 70. The electrical apparatus comprises a first electrical contact input 71 connected to the second movable part 33, and a second electrical contact input 72 connected to a first contact zone 32 of the first part by means of the first magnetizable element 31, and a third electrical contact input 73 connected to a third contact zone 42 of the first part by means of the third magnetizable element. The control circuit 70 is connected to a first and second electromagnetic coil 53 and 54 respectively arranged on the first and third magnetizable element 31 and 39 of the first part. In the embodiment of FIG. 16, the coils 53 and 54 are connected in series to control movement of the movable part in attraction and repulsion. The movable part 33 can comprise magnets in the material that composes it. Manual or mechanical actuating means 50 can also act on the second movable part to make the latter change stable state. The control circuit 70 comprises control inputs 74 able to receive control signals.

The control signals applied to the control inputs 70 can be in particular polarization signals, pulse duration signals and/or number of pulse signals.

Figure 17:
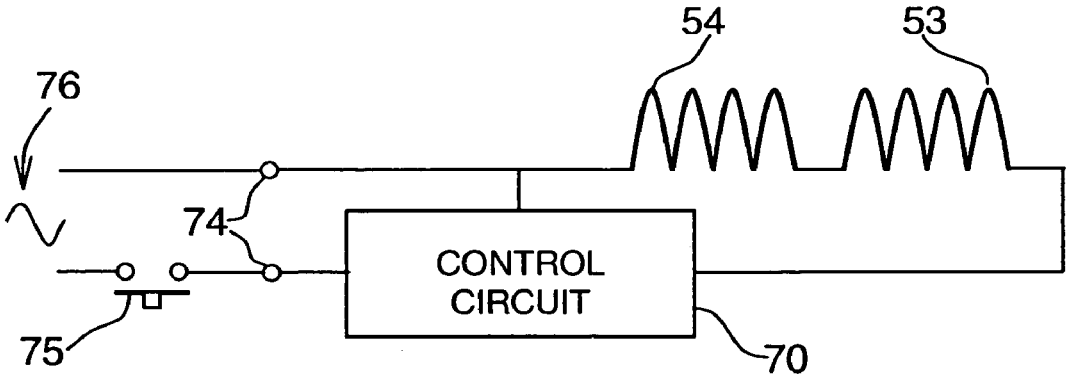
FIG. 17 represents a diagram of control of a switching device according to an embodiment of the invention.

In the diagram of FIG. 17, the coils 53 and 54 are connected with the control circuit to the inputs 74. In this diagram, the apparatus then receives control signals in the form of electrical pulses supplied by a push-button 75 connected between the inputs 74 and an electric power source 76, for example a mains power distribution system. The control circuit can act on the coils by simple switch or remote-controlled reversing switch commands or, for example, by more complex functions such as remote control switch, time delay device, or electric time switch functions.

Figure 18:
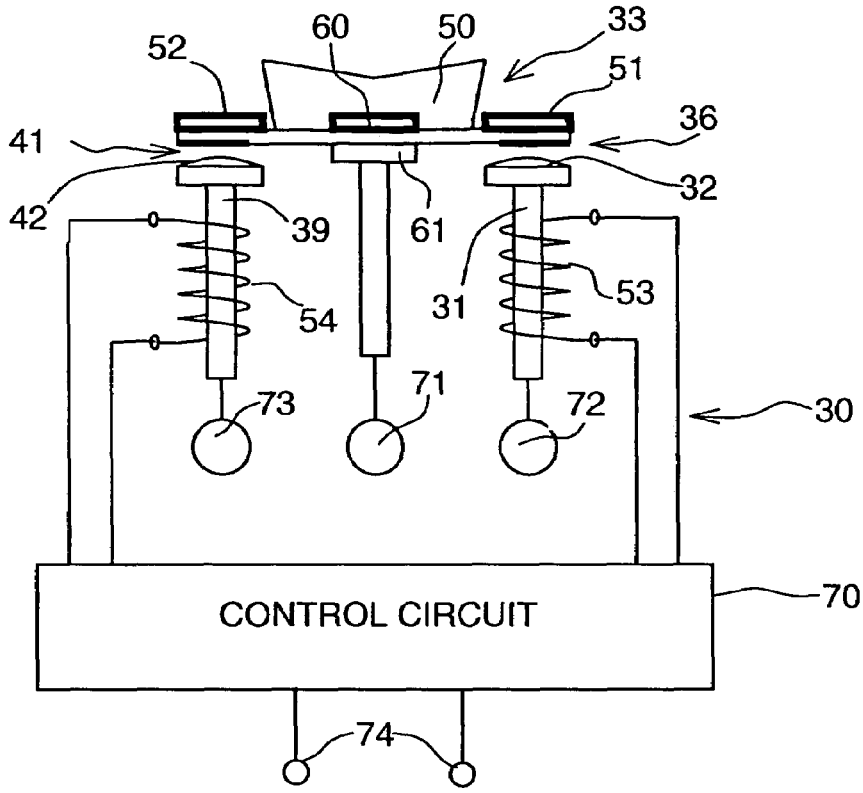
FIG. 18 represents a diagram of an electrical apparatus comprising a switching device with three stable positions according to an embodiment of the invention and a control circuit.

FIG. 18 represents a diagram of an electrical apparatus comprising a switching device with three stable positions such as the one described for FIGS. 8 to 10 and a control circuit 70. The coils 53 and 54 are connected to the control circuit to be able to be commanded in attraction and repulsion to establish at least one electrical contact 36 or 41 and in double repulsion to open said electrical contacts. A magnet 60 and a fourth magnetizable element 61 enable the movable part to be kept in the open contacts position.

Figure 19:
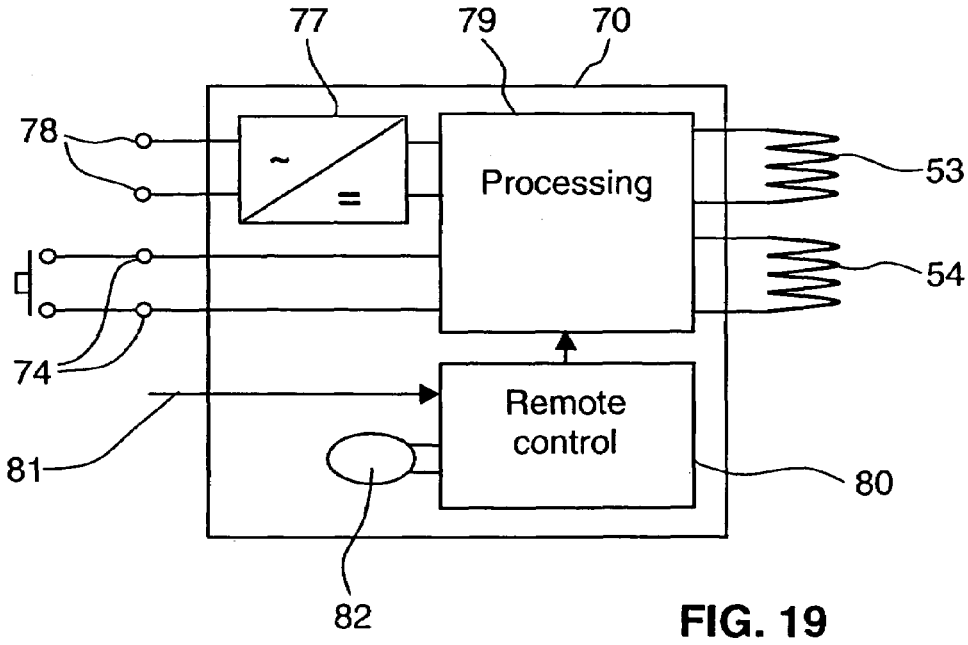
FIG. 19 represents a diagram of a control circuit.

In FIG. 19, a diagram of a control circuit shows different possibilities of receipt of control signals. The control circuit 70 comprises a power supply circuit connected between power supply inputs 78 and a processing circuit 79. The control circuit 70 controls the coils 53 and 54 according to control signals received in particular on control inputs 74.

The control circuit 70 can also comprise a remote control circuit connected to the processing circuit and receiving control signals supplied via a communication bus 81 and/or a remote control receiver.

FIGS. 20A, 20B, 20C, 21 and 22 represent control signals able to be used by control circuits of switching devices according to embodiments of the invention. In FIG. 20A a signal 90 of negative polarity can command the control circuit 70 to position the switching device in a first stable position where a first contact 36 is established. In FIG. 20B a signal 91 of positive polarity can command the control circuit 70 to position the switching device in a second stable position where a second contact 41 is established. In FIG. 20C a signal 92 having negative and positive polarities can command the control circuit 70 to position the switching device in a third stable position where the contacts 36 and 41 are opened in particular by double repulsion commands on the coils 53 and 54. FIG. 21 represents control signals 93 by pulse duration, and FIG. 22 represents control signals 94 by number of pulses.

FIG. 23 represents a particular embodiment of a second movable part 33 having a flexible constitution able to be fixed by a point 100 situated in a central zone, and comprises at least one contact zone 35 and/or 43 and a magnet 51 and/or 52 towards at least one end. The second movable part comprises one or two openings towards a central zone to improve the flexibility and movement between the stable positions. The body of the movable part can advantageously be formed by a material such as brass or steel.

FIG. 24 represents a switching device comprising a second movable part according to FIG. 23. The point 100 of the central zone is fixed directly onto the support element 56. In this embodiment, the flexible constitution of the second movable part also enables the two contacts 36 and 41 to be closed simultaneously. Thus, the contacts can be opened or closed independently, in particular by electromagnetic controls.

In FIG. 25, a second movable part 33 is composed of a material comprising a mainly permanent magnetization part, for example a longitudinal magnet 103 comprising contact pads at each end.

In the embodiments described above, the electrical contact zones can be achieved by deposits of suitable metal or by adding contact pads of small thickness. The magnets can have different shapes and be fixed onto fixed or movable parts of the magnetic elements. The magnetic or magnetizable elements can also be covered with material depending on the intensity of the current which has to flow through the contacts. The current can reach several amperes in a small volume.

The electrical apparatuses able to comprise a switching device according to the invention can be of very different kinds, for example low or high power switches, circuit breakers, auxiliary contacts, or contacts controlled by mechanisms or manually.

The invention claimed is:

1. An electrical switching device comprising:

at least one electrical contact able to be kept in a stable position by magnetic means, which contact comprises:

a first part comprising a first magnetizable element and a first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, such that an axis between the first magnetizable element and the first magnetic element passes through the first and second contact zones.

2. The switching device according to claim 1, wherein the second movable part comprises at least one permanent magnet located in proximity to a contact zone.

3. The switching device according to claim 1, wherein the second movable part comprises a material comprising a mainly permanent magnetization part.

4. The switching device according to claim 1, wherein the permanent magnetization part has a magnetic induction greater than 1 tesla.

5. The switching device according to claim 1, comprising actuating means acting on the second movable part for causing it to change stable state.

6. An electromagnetic relay having at least two stable states comprising first and second electrical contact inputs and control inputs, at least one switching device according to claim 1, the first electrical contact input being connected to the second movable part, the second electrical contact input being connected to a first contact zone of the first part, and the control inputs being connected to at least a first electromagnetic coil located on at least a first magnetizable element of the first part.

7. A relay according to claim 6, comprising at least a second electromagnetic coil connected to the control inputs and located on at least a second magnetizable element of the first part.

8. A relay according to claim 6, having at least three stable states and comprising a third contact zone connected to a third contact input, and means for keeping the second movable part in a third stable position wherein the electrical contacts between the first, second, and third contact zones are open, the first and second electromagnetic coils for attracting and repelling to establish an electrical contact and for double repelling to open the contacts.

9. An electrical switching device comprising at least one electrical contact able to be kept in a stable position by magnetic means which contact comprises:

a first part comprising a first magnetizable element and a first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, wherein the electromagnetic actuating means comprise a second electromagnetic coil wound onto a second magnetizable element of the first part for attracting or repelling a second magnetic element of the second moveable part and for changing the stable state of said second movable part.

10. The switching device according to claim 9, wherein the first and second electromagnetic coils controllable by electrical pulses to generate reverse magnetic fields for changing the stable position of the second movable part change between first and second stable positions closing at least one electrical contact between a contact zone of the first part and a contact zone of the second movable part.

11. The switching device according to claim 9, wherein the first and second electromagnetic coils are controllable by electrical pulses to generate magnetic fields of the same direction for positioning the second movable part in a third stable position wherein the contact zones of the second movable part are not in electrical contact with the contact zones of the first part.

12. An electrical switching device comprising:

at least one electrical contact able to be kept in a stable position by magnetic means, which contact comprises a first part comprising a first magnetizable element and first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, such that an axis between the first magnetizable element and the first magnetic element passes through the first and second contact zones, wherein the first part comprises a second magnetizable element for keeping the second movable part in the second stable condition.

13. An electrical switching device comprising at least one electrical contact able to be kept in a stable position by magnetic means, which contact comprises:

a first part comprising a first magnetizable element and a first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, wherein the second movable part has an elongate shape, is able to pivot, and comprises at least one contact zone and one magnetic attraction zone towards at least one end thereof.

14. The switching device according to claim 13, wherein the second movable part comprises at least one contact zone at a first end thereof and at least one permanent magnet at a second end thereof.

15. An electrical switching device comprising at least one electrical contact able to be kept in a stable position by magnetic means, which contact comprises:

a first part comprising a first magnetizable element and a first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, wherein the second movable part is flexible, is able to be fixed by a point situated in a central zone thereof, and comprises at least one contact zone and one magnet towards at least one end thereof.

16. The switching device according to claim 15, wherein the second movable part comprises at least one opening in said central zone.

17. An electrical switching device comprising at least one electrical contact able to be kept in a stable position by magnetic means, which contact comprises:

a first part comprising a first magnetizable element and a first contact zone associated with said magnetizable element, a second moveable pall comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, wherein:

the first part comprises the first magnetizable element associated with said first contact zone and a second magnetizable element associated with a third contact zone, and the second movable part comprises said second contact zone towards a first end designed to be in contact with the first contact zone of the first part, and a fourth contact zone towards a second end designed to be in contact with the third contact zone of the first part, so that when in a first stable position of the movable part, the first and second contact zones form a closed contact and the third and fourth contact zones form an open contact, and in a second stable position of the movable part, the third and fourth contact zones form a closed contact and the first and second contact zones form an open contact.

18. The switching device according to claim 17, wherein the first, second, third and fourth contact zones are electrically connected to electrical connection means.

19. The switching device according to claim 17, wherein the second movable part comprises a first permanent magnet towards the first end thereof for operating in conjunction with the first magnetizable element of the first part, and a second permanent magnet towards the second end thereof for operating in conjunction with the second magnetizable element of the first part.

20. The switching device according to claim 17, comprising maintaining means for keeping the second movable part in a third stable position wherein both the contact formed by the first and second contact zones and the contact formed by the third and fourth contact zones are open.

21. The switching device according to claim 20, wherein the maintaining means comprise a support element which includes a flat part located on the first part for receiving a first side of the second movable part, and pressure means for keeping a central zone of the second movable part in contact with said support element.

22. The switching device according to claim 21, wherein the pressure means is a spring.

23. The switching device according to claim 21, wherein the pressure means comprise a third permanent magnet and a third magnetizable element located on the support element and on the central zone of the movable part.

24. An electrical switching device comprising at least one electrical contact able to be kept in a stable position by magnetic means, which contact comprises:

a first part comprising a first magnetizable element and a first contact zone associated with said magnetizable element, a second moveable part comprising a first magnetic element and a second contact zone associated with said first magnetic clement, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable clement or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, wherein the second movable part is flexible, is able to be fixed by a point situated in a central zone, and comprises at least one contact zone and a magnet having two ends for forming two contacts with contact zones of magnetizable elements of the first part, said two contacts capable of being closed simultaneously.

25. An electrical switching device comprising

At least one electrical contact able to be kept in a stable position by magnetic means, which contact comprises:

a first part comprising a first magnetizable element and a first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, wherein said first magnetizable element is sufficiently electrically conductive and permits an electric current, which will flow in said at least one electrical contact, to be conducted through it.

26. An electrical apparatus comprising at least first and second electrical contact inputs, comprising:

at least one switching device comprising at least one electrical contact able to be kept in a stable position by magnetic means said contact comprising:

a first part comprising a first magnetizable element and a first contact zone associated with said magnetizable element, a second moveable part comprising a first magnetic element and a second contact zone associated with said first magnetic element, the second movable part having a first stable position wherein a first electrical contact is kept closed between the first and second contact zones and a second stable position wherein said first electrical contact is kept open, and electromagnetic actuating means acting on the second movable part for causing the latter to change position and comprising a first electromagnetic coil wound onto said first magnetizable element of the first part for attracting or repelling a first magnetic element of the second movable part and for changing the stable state of said movable part, the first magnetizable element or the first magnetic element comprising a permanent magnetization part located in proximity to a contact zone for keeping the first electrical contact closed and for exerting a contact pressure between the first and second contact zones by a magnetic attraction exerted directly between the first magnetizable element and the first magnetic element when the movable part is in its first stable position, said switching device having at least two stable positions, the first electrical contact input being connected to the second movable part, the second electrical contact input being connected to the first contact zone of the first part, and a control circuit connected to at least a first electromagnetic coil located on the first magnetizable element of the first part.

27. An electrical apparatus according to claim 26, wherein the switching device comprises at least a second electromagnetic coil connected to the control circuit and located on at least a second magnetizable element of the first part.

28. An electrical apparatus according to claim 26, wherein the switching device has three stable states and comprises a third contact zone connected to a third contact input and means for keeping the second movable part in a third stable position wherein the electrical contacts between the first, second, and third contact zones are open, the first and second electromagnetic coils for attracting and repelling to open the contacts.

29. An electrical apparatus according to claim 26, comprising actuating means for acting on the second moving part to make it change stable state.

30. An electrical apparatus according to claim 26, wherein the control circuit comprises at least one control input for receiving control signals.

31. An electrical apparatus according to claim 30, wherein the control signals applied to the input are selected from the group consisting of polarization signals, pulse duration signals, and number of pulse signals.

32. An electrical apparatus according to claim 26, wherein the control circuit comprises remote control input by communication bus for receiving control signals.

33. An electrical apparatus according to claim 26, wherein the control circuit comprises remote control receipt means for receiving control signals.

34. An electrical apparatus according to claim 26, wherein the control circuit comprises processing means for processing control signals and for controlling the electromagnetic coils according to said signals.

35. An electrical apparatus according to claim 34, wherein the processing means is for performing at least one function selected from the group consisting of remote control switch, timer and controlled switch functions.

* * * * *